US007008179B2

(12) United States Patent
Rinck et al.

(10) Patent No.: US 7,008,179 B2
(45) Date of Patent: Mar. 7, 2006

(54) TURBINE BLADE FREQUENCY TUNED PIN BANK

(75) Inventors: Gerard Anthony Rinck, Cleves, OH (US); Jonathan Philip Clarke, West Chester, OH (US); Mark Edward Stegemiller, Franklin, OH (US); Hardev Singh, Mason, OH (US); Steven Robert Brassfield, Cincinnati, OH (US)

(73) Assignee: General Electric Co., Schenectady, NY (US)

( * ) Notice: Subject to any disclaimer, the term of this patent is extended or adjusted under 35 U.S.C. 154(b) by 72 days.

(21) Appl. No.: 10/737,428

(22) Filed: Dec. 16, 2003

(65) Prior Publication Data

US 2005/0129516 A1 Jun. 16, 2005

(51) Int. Cl.
*F01D 25/36* (2006.01)

(52) U.S. Cl. ..... 415/119; 416/97 R; 416/233; 416/500; 416/236 A

(58) Field of Classification Search ..... 415/119; 416/97 R, 95, 96 R, 96 A, 233, 236 A, 500
See application file for complete search history.

(56) References Cited

U.S. PATENT DOCUMENTS 4,961,686 A 10/1990 Blair et al.
5,536,143 A * 7/1996 Jacala et al. ..... 416/96 R
5,591,009 A 1/1997 Mannava et al.
5,988,982 A 11/1999 Clauer
6,132,169 A 10/2000 Manning et al.
6,174,134 B1 1/2001 Lee et al.
6,257,831 B1 * 7/2001 Papple et al. ..... 416/97 R
6,462,308 B1 10/2002 Lahrman et al.
6,481,972 B1 11/2002 Wang et al.
6,542,859 B1 * 4/2003 Burns et al. ..... 703/7

* cited by examiner

*Primary Examiner*—Edward K. Look
*Assistant Examiner*—Dwayne J. White
(74) *Attorney, Agent, or Firm*—William Scott Andes; Steven J. Rosen

(57) ABSTRACT

A gas turbine engine turbine blade includes a hollow airfoil extending radially from a blade root to a radially outer airfoil tip. The airfoil includes an airfoil outer wall having transversely spaced apart pressure and suction side walls meeting along chordally spaced apart leading and trailing edges of the airfoil. A radially extending cooling air supply channel within the airfoil includes a bank of pins integral with and extending transversely between the pressure and suction side walls. The bank of the pins is tuned such that a natural frequency of the blade associated with an engine forced driving mode of the blade is sufficiently away from a steady state engine operating frequency to substantially avoid natural frequency resonance of the blade during steady state engine operation. The bank of the pins is tuned by locations of the pins within the cooling air supply channel.

27 Claims, 4 Drawing Sheets

TURBINE BLADE FREQUENCY TUNED PIN BANK

BACKGROUND OF THE INVENTION

1. Field of the Invention

This invention relates to coolable hollow gas turbine engine turbine blades and, more particularly, to pins extending between pressure and suction side walls of the blades.

2. Description of Related Art

Gas turbine engines typically employ a row of coolable hollow turbine blades secured to an outer perimeter of a rotor disk with a stationary turbine nozzle having a plurality of stator vanes disposed upstream therefrom. The combustion gases flow between the stator vanes and between the turbine blades for extracting energy to rotate the rotor disk. The temperatures within gas turbines may exceed 2500 degrees Fahrenheit and cooling of turbine blades is very important in terms of blade longevity. Without cooling, turbine blades would rapidly deteriorate. Cooling for turbine blades is very desirable and much effort has been devoted by those skilled in the blade cooling arts to devise geometries for internal cavities within turbine blades in order to enhance cooling. Since the combustion gases are hot, the turbine vanes and blades are typically cooled with a portion of compressor air bled from the compressor for this purpose. Diverting any portion of the compressor air from use in the combustor necessarily decreases the overall efficiency of the engine. It is desirable to cool the vanes and blades with as little compressor bleed air as possible.

Typical turbine vanes and blades include an airfoil over which the combustion gases flow. The airfoil, typically, includes one or more straight through channels and serpentine cooling passages through which cooling air from compressor bleed air is channeled for cooling the airfoil. The airfoil may include various turbulators therein for enhancing cooling effectiveness and the cooling air is discharged from the passages through various film cooling holes disposed around the outer surface of the airfoil. In pursuit of higher cooling effectiveness, modern blades have led to multi-pass cooling circuits.

It is also known to pass the cooling air through serpentine cooling air circuits and other passages in the interior of the blade which warms up the cooling air as it travels through the passages before being impinged on the leading edge of the blade. The temperature difference across the leading edge is lower than directing cooling air through the root of the blade for impingement resulting in lower thermal stresses in the blade leading edge and the life of the blade is enhanced. This makes efficient use of cooling flow since the flow is able to internally cool the blade over much of the blade mid-span before flowing out radial leading edge cooling holes to film cool the blade airfoil externally.

Known turbine airfoil cooling techniques include the use of internal cavities forming a serpentine cooling circuit. Particularly, serpentine passages, leading edge impingement bridges, turbulence promoters and turbulators, film holes, pins, and trailing edge holes or pressure side bleed slots are utilized for blade cooling.

The hollow turbine blades are subject to resonance at natural frequencies of the blade and it is known to modify blades and designs thereof to avoid operating at the natural frequencies of the blade for other than transient periods during engine operation. It is desirable to cool turbine blades with as little cooling air as possible and which substantially avoids operating at the natural frequencies of the blade for other than transient periods during engine operation.

SUMMARY OF THE INVENTION

A gas turbine engine turbine blade includes a hollow airfoil including an airfoil outer wall having transversely spaced apart pressure and suction side walls meeting along chordally spaced apart leading and trailing edges of the airfoil. A radially extending trailing edge cooling air channel within the airfoil includes a bank of pins integral with and extending transversely between the pressure and suction side walls. The pins may be heat transfer pins. The bank of the pins is tuned such that a natural frequency of the blade associated with an engine forced driving mode of the blade is sufficiently away from a steady state engine operating frequency to substantially avoid natural frequency resonance of the blade during steady state engine operation. The number, size, and location of the pins may also be optimized to minimize weight, minimize pressure loss, as well as frequency tune the blade.

An exemplary embodiment of the blade includes the bank of the pins tuned for predicted or predetermined frequencies associated with engine driving modes as for example a second torsion mode 2T indicated by a nodal line. In an iterative process, predetermined natural frequencies for different configurations of the bank can be analytically determined such as by using an ANSYS analytical computer code. The iterative process can be used to determine the final configuration of the bank of the pins.

The 2T nodal line as illustrated herein passes chordally across the trailing edge cooling air channel and the pins are unevenly distributed radially about the nodal line. The pins are unevenly distributed radially about the nodal line such as by having an uneven number of the pins above and below the nodal line. An example of this includes the bank having a total of 9 pins of which 4 of the pins are above and 5 of the pins are below the nodal line.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
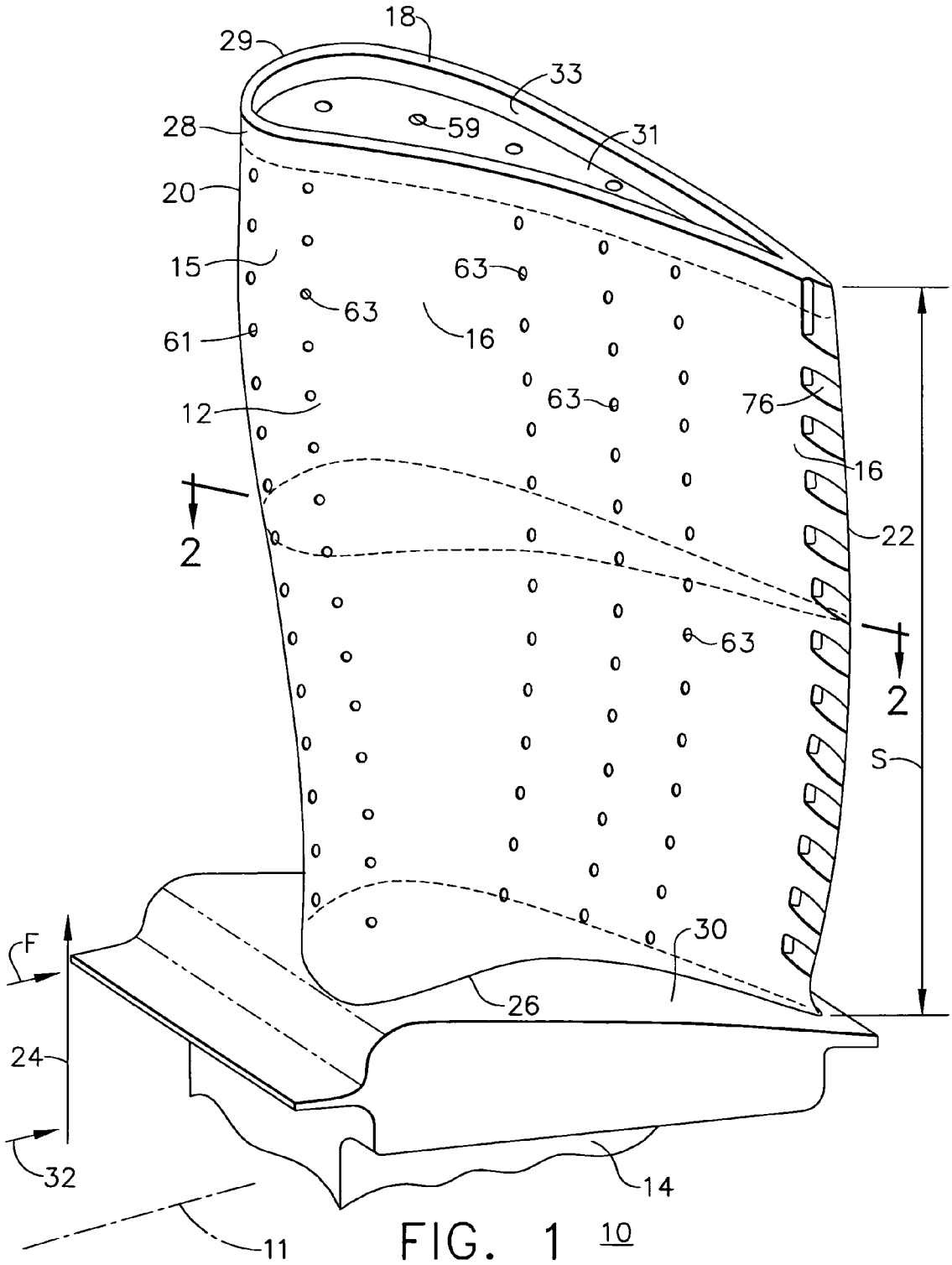
FIG. 1 is a perspective view illustration of a gas turbine engine turbine blade with a bank of frequency tuned pins.

Illustrated in FIG. 1 is an exemplary turbine blade 10 for a gas turbine engine designed to be operated in a hot gas stream that flows in an axial flow downstream direction F. The blade 10 includes a hollow airfoil 12 extending radially outwardly from a root 14. The root 14 is used to secure the blade 10 to a rotor disk (not shown) of the engine which is circumscribed about an engine centerline 11. As further illustrated in a cross-section of the airfoil 12 in FIG. 2, the airfoil 12 includes an outer wall 15 widthwise or transversely spaced apart pressure and suction side walls 16 and 18, respectively, meeting along an upstream leading edge 20 and a downstream trailing edge 22 which is spaced chordally apart from the leading edge. The airfoil 12 extends radially in a radial direction 24 away from the engine centerline 11 in a spanwise direction of the airfoil 12 from a radially inner base 26 to a radially outer airfoil tip 28 along a span S of the airfoil. The airfoil tip 28 is illustrated as a squealer tip having an outward extension from the outer wall 15 or a squealer wall 29 extending radially outward from and peripherally around an outer tip wall 31 forming a squealer tip cavity 33 therein. Tip cooling holes 59 extending through the outer tip wall 31 from within the hollow airfoil 12 to the squealer tip cavity 33 are used to cool the tip cavity. The radially inner base 26 is defined at a conventional platform 30 which forms the inner flow boundary of the blade 10 and below which extends the root 14.

During operation of the blade 10, combustion gases 32 are generated by a combustor (not shown) and flow in an axial downstream direction F over both airfoil pressure and suction side walls 16 and 18, respectively, of the outer wall 15. The exemplary embodiment of the present invention illustrated herein is designed to effect efficient cooling of the airfoil 12 to better match the distribution of the heat load thereto from the combustion gases 32. The gas turbine blade 10 illustrated in FIGS. 1–3 is exemplary and the invention applies equally as well to turbine stator vanes having similar airfoils which may be similarly cooled.

Figure 2:
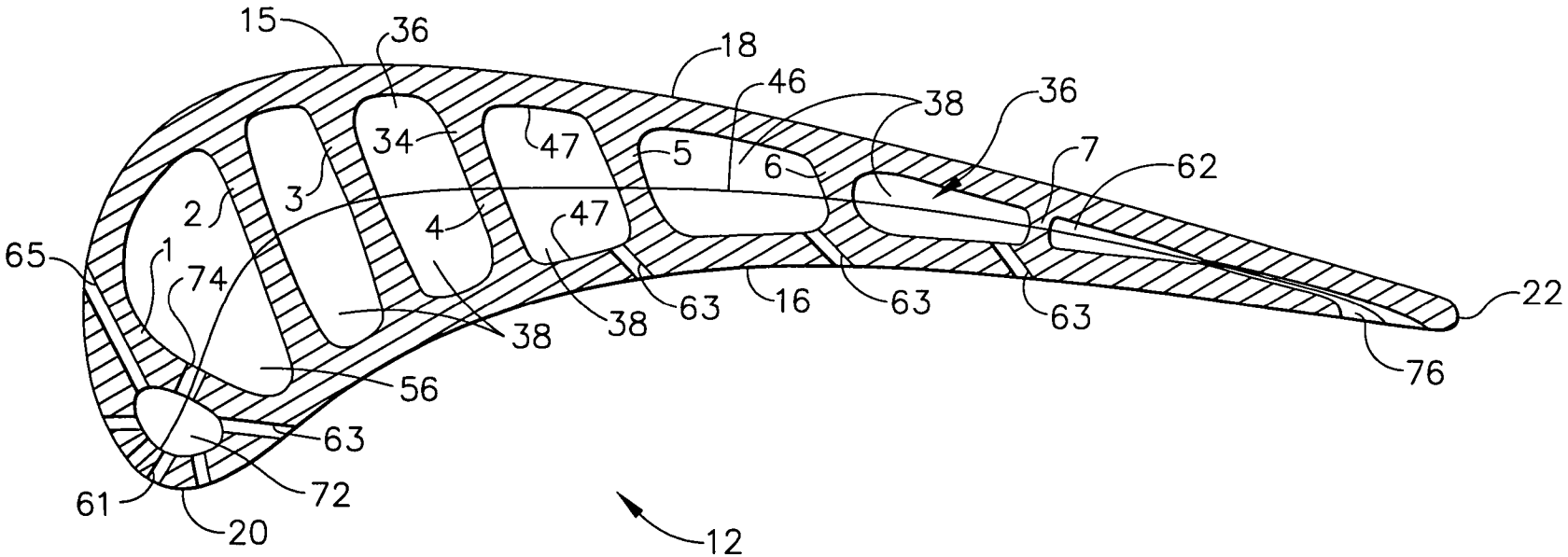
FIG. 2 is a sectional schematic illustration of an airfoil mid-span cross-section through line 2—2 of the airfoil illustrated in FIG. 1.

Referring to FIG. 2, the hollow airfoil 12 is illustrated in cross-section with the outer wall 15 and the pressure and suction side walls 16 and 18, respectively, spaced circumferentially or laterally apart from each other between the leading and trailing edges 20 and 22. The pressure and suction side walls 16 and 18 are integrally joined together by an internal radially extending plurality (seven illustrated in the exemplary FIGS. herein) of transverse ribs 34 designated first through seventh rib 1–7 which extend between the pressure and suction side walls 16 and 18, respectively. Third through seventh ribs 3–7, respectively, of the transverse ribs 34 define a single forward flowing five pass serpentine cooling circuit 36 as illustrated in FIGS. 3 and 4.

Figure 3:
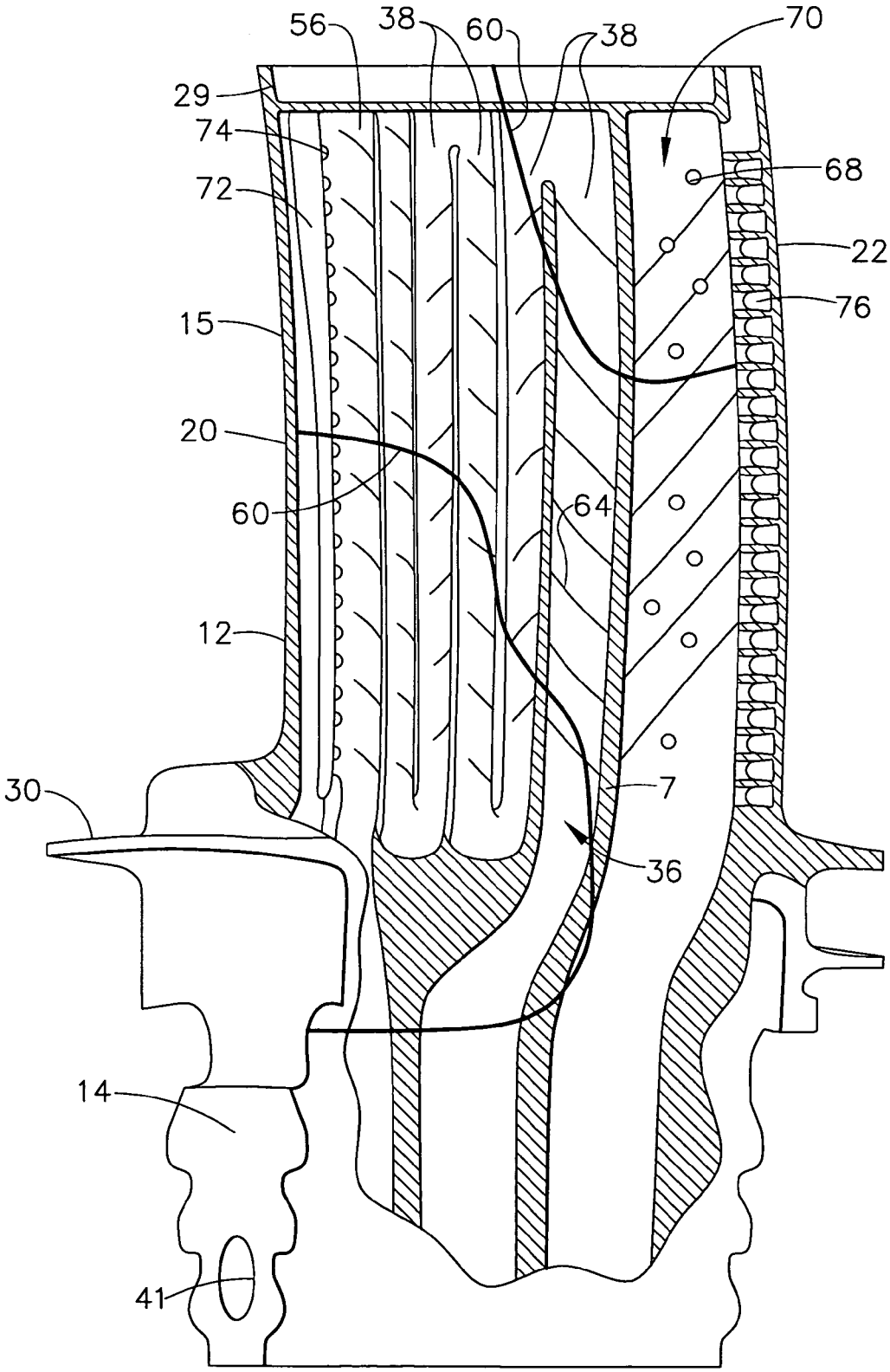
FIG. 3 is a partially cutaway perspective view illustration of the blade illustrated in FIG. 1.
Figure 4:
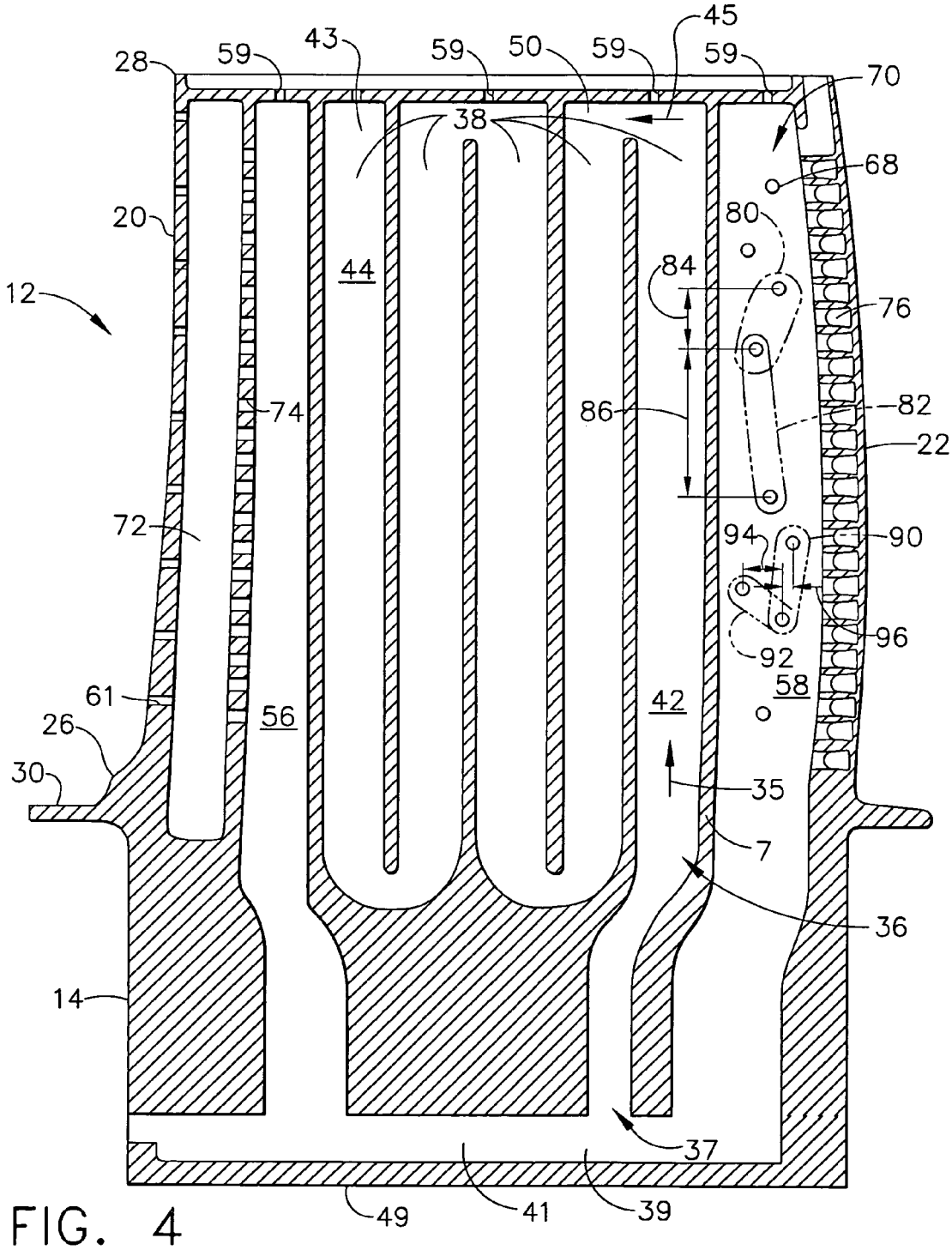
FIG. 4 is a sectional view illustration of the exemplary turbine airfoil illustrated in FIG. 1 laid out flat along a split-line in FIG. 3 through a cooling circuit therein.

FIG. 3 is a partially cutaway perspective view of the blade 10 while FIG. 4 illustrates the airfoil 12 laid out flat along a cooling circuit split-line 46 in FIG. 2 that passes through the forward flowing serpentine cooling circuit 36. The forward flowing serpentine cooling circuit 36 is constructed so as to cause a serpentine cooling flow 35 within the cooling circuit 36 to flow in a forward chordal flow direction 45, forwards from the trailing edge 22 to the leading edge 20 within the forward flowing serpentine cooling circuit 36. The forward flowing cooling circuit 36 includes an entrance 37 through the root 14 and which is in cooling flow communication with a cooling air supply 39. The cooling air supply 39 illustrated herein is a cooling air supply channel 41 axially extending through the root 14. Alternatively, it is well known to supply cooling air to the airfoil radially to the entrance 37 through a bottom surface 49 of the root 14. The entrance 37 is positioned aft of a terminal end 43 of the forward flowing cooling circuit to cause the serpentine cooling flow 35 to flow in the forward chordal flow direction 45 forwards from the trailing edge 22 to the leading edge 20.

The forward flowing serpentine cooling circuit 36 is referred to as a five pass circuit because it has five radially extending serpentine channels 38. The serpentine cooling circuit 36 is defined by and disposed between the chordally spaced apart ribs 34 and bounded on their transverse sides 47 (illustrated in FIG. 2) by the pressure side and suction side walls 16 and 18.

A first channel 42 of the forward flowing serpentine cooling circuit 36 extends radially through the base 26 of the airfoil 12 and through the root 14 of the blade 10 and radially upwardly to a radially outer first turning channel 50. The first channel 42 begins at an entrance 37 in the bottom surface 49 of the root 14 of the airfoil 12. A last cooling channel 44 of the forward flowing serpentine cooling circuit 36 terminate at the outer tip wall 31 where one or more of the tip cooling holes 59 may be used to vent the serpentine cooling circuit. The airfoil squealer tip is cooled by tip cooling holes 59 in the outer tip wall 31.

In the exemplary embodiment illustrated herein, a leading edge cooling plenum 72 is located between the leading edge 20 of the outer wall 15 and the first rib 1. Discharge apertures 74, which also function as impingement cooling holes, are disposed and extend through the first rib 1 from a leading edge cooling air supply channel 56 to the leading edge cooling plenum 72. The leading edge cooling air supply channel 56 includes another entrance 37 through the root 14 and which is in cooling flow communication with the cooling air supply 39. Alternatively, it is well known to supply cooling air to the airfoil radially to the entrance 37 through the bottom surface 49 of the root 14.

The discharge apertures 74 feed cooling air from the leading edge cooling air supply channel 56 to the leading edge cooling plenum 72 from where it is flowed through film cooling holes. The film cooling holes include one or more of the following: shower head, pressure side wall, and suction side wall film cooling holes, 61, 63, and 65, respectively.

In the exemplary embodiment illustrated herein, the trailing edge cooling air supply channel 58 includes another entrance 37 through the root 14 and which is in cooling flow communication with the cooling air supply 39. Alternatively, it is well known to supply cooling air to the airfoil radially to the entrance 37 through the bottom surface 49 of the root 14. The trailing edge cooling air supply channel 58 feeds or passes cooling air through trailing edge apertures in the form of trailing edge cooling slots 76 to convectively cool the trailing edge 22.

Film cooling holes are disposed through both the pressure and suction side walls 16 and 18, respectively, of the outer wall 15. The airfoil 12 may have any other conventional features for enhancing the cooling thereof such as angled turbulators 64 and a bank 70 of pins 68, both of which are well known in the art for cooling airfoils. The pins may be heat transfer pins. Thermal barrier coatings TBC, well known in the technology, may also be used to improve thermal characteristics of the airfoil 12. The pins 68, also referred to as pedestals, typically have round cross-sections but may also have other shapes.

The hollow turbine blades 10 are subject to resonance at natural frequencies of the blade and thus the pins 68 are tuned to avoid operating at the natural frequencies of the blade for steady state engine operating conditions. Steady state engine operation includes takeoff, landing, and particularly cruise conditions or operating conditions other than transient periods during engine operation. It is also desirable to optimize or further tune the number, size, and shape of the pins 68 to cool the turbine blade 10 with as little cooling air as possible while substantially avoiding operating at the natural frequencies of the blade for other than transient periods during engine operation.

The bank 70 of the pins 68 is tuned such that a natural frequency of the blade 10 associated with an engine forced driving mode of the blade 10 is sufficiently away from a steady state engine operating frequency to substantially avoid natural frequency resonance of the blade 10 during steady state engine operation. The bank 70 of the pins 68 is tuned by locations of the pins 68 within the cooling air supply channel 58. The bank 70 of the pins 68 is further tuned by the number, size, as well as the location of the pins 68. The number, size, as well as the location of the pins 68 may also be optimized to minimize weight, minimize cooling pressure losses within the cooling air supply channel 58, as well as frequency tune the blade 10. The tuned bank 70 of the pins 68 may be tuned to provide additional natural frequency margins to already existing designs.

The frequency tuned bank 70 of the pins 68 is illustrated herein within the trailing edge cooling air supply channel 58 but may be used in places including different channels within a hollow airfoil of a turbine blade. The same is true for optimizing the number, size, as well as the location of the pins 68 for frequency response and to minimize weight, minimize cooling pressure losses within the cooling air supply channel 58, as well as frequency tune the blade 10.

The exemplary embodiment of the blade 10 illustrated herein has a bank 70 of the pins 68 tuned using predicted or predetermined natural frequencies of the blade 10 as for example a second torsion mode 2T as illustrated in FIG. 3 by a 2T nodal line 60. The predetermined natural frequencies of the blade 10 and associated engine driving modes were analytically determined. More particularly, the predetermined natural frequencies were analytically determined using an ANSYS analytical computer code. An iterative process was used to determine the final configuration of the bank 70 of the pins 68. Various configurations of the pins 68 were analyzed to arrive at the optimized frequency tuned configuration or design of the bank 70. The predetermined natural frequencies of the blade 10 may also be determined using empirical techniques as well as a combination of empirical and analytical techniques such as the use of an ANSYS analytical computer code.

The bank 70 of the pins 68 was designed to avoid a natural frequency associated with the second torsion mode 2T as illustrated in FIG. 3 by the 2T nodal line 60. The nodal line 60 passes chordally across the trailing edge cooling air supply channel 58 and the pins 68 are unevenly distributed radially about the nodal line 60. The exemplary embodiment of the blade 10 illustrated herein is frequency tuned to avoid the second torsion mode 2T and the pins 68 are unevenly distributed radially about the nodal line 60. A more particular embodiments of the frequency tuned bank 70 include an uneven number of the pins 68 above and below the nodal line 60. This is illustrated in FIGS. 3 and 4 by the bank 70 having a total of 9 pins 68 of which 4 of the pins 68 are above and 5 of the pins 68 are below the nodal line 60.

Among the methods of designing and the designs of the frequency tuned bank 70 of the pins 68 illustrated herein is an uneven radial distribution of the pins 68. This embodiment includes at least one set of first and second radially adjacent pairs 80 and 82 of the pins 68 having unequal first and second radial spacings 84 and 86, respectively. Another embodiment of the frequency tuned bank 70 of the pins 68 illustrated herein has an uneven axial distribution of the pins 68. This embodiment includes at least one set of first and second axially adjacent pairs 90 and 92 of the pins 68 have unequal first and second axial spacings 94 and 96, respectively. Yet another embodiment of the frequency tuned bank 70 of the pins 68 illustrated herein has an uneven axial and radial distribution of the pins 68.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed is:

1. A gas turbine engine turbine blade comprising:

a hollow airfoil extending radially from a blade root to a radially outer airfoil tip, the airfoil including an airfoil outer wall having transversely spaced apart pressure and suction side walls meeting along chordally spaced apart leading and trailing edges of the airfoil, a radially extending cooling air supply channel within the airfoil, a bank of pins integral with and extending transversely between the pressure and suction side walls within the radially extending cooling air channel, and the bank of the pins is tuned such that a natural frequency of the blade associated with an engine forced driving mode of the blade is sufficiently away from a steady state engine operating frequency to substantially avoid natural frequency resonance of the blade during steady state engine operation.

2. A blade as claimed in claim 1 further comprising the number, size, and location of the pins optimized to minimize weight, minimize pressure loss, and frequency tune the blade.

3. A blade as claimed in claim 1 wherein the bank of the pins was tuned using predetermined natural frequencies.

4. A blade as claimed in claim 3 wherein the predetermined natural frequencies were analytically determined.

5. A blade as claimed in claim 4 wherein the predetermined natural frequencies were analytically determined using an ANSYS analytical computer code.

6. A blade as claimed in claim 1 further comprising an uneven radial distribution of the pins.

7. A blade as claimed in claim 1 further comprising an uneven axial distribution of the pins.

8. A blade as claimed in claim 1 further comprising uneven radial and axial distributions of the pins.

9. A blade as claimed in claim 1 wherein the engine forced driving mode of the blade is a second torsion mode.

10. A blade as claimed in claim 1 further comprising:

a nodal line associated with the engine forced driving mode of the blade, the nodal line passing chordally across the cooling air supply channel, and the pins being unevenly distributed radially about the nodal line.

11. A blade as claimed in claim 10 further comprising an uneven number of the pins above and below the nodal line.

12. A blade as claimed in claim 10 further comprising the pins unevenly radially spaced above and below the nodal line.

13. A blade as claimed in claim 10 further comprising an uneven number of the pins above and below the nodal line and the pins being unevenly radially spaced above and below the nodal line.

14. A blade as claimed in claim 1 further comprising the cooling air supply channel being a trailing edge cooling air supply channel and trailing edge apertures leading from the cooling air supply channel through the trailing edge.

15. A blade as claimed in claim 14 wherein the bank of the pins was tuned using predetermined natural frequencies.

16. A blade as claimed in claim 15 wherein the predetermined natural frequencies were analytically determined.

17. A blade as claimed in claim 16 wherein the predetermined natural frequencies were analytically determined using an ANSYS analytical computer code.

18. A blade as claimed in claim 17 wherein the predetermined natural frequencies were analytically determined in an iterative analysis.

19. A blade as claimed in claim 14 further comprising an uneven radial distribution of the pins.

20. A blade as claimed in claim 14 further comprising an uneven axial distribution of the pins.

21. A blade as claimed in claim 14 further comprising uneven radial and axial distributions of the pins.

22. A blade as claimed in claim 14 wherein the engine forced driving mode of the blade is a second torsion mode.

23. A blade as claimed in claim 14 further comprising:

a nodal line associated with the natural frequency mode of the blade, the nodal line passing chordally across the cooling air supply channel, and the pins being unevenly distributed radially about the nodal line.

24. A blade as claimed in claim 23 further comprising an uneven number of the pins above and below the nodal line.

25. A blade as claimed in claim 23 further comprising the pins unevenly radially spaced above and below the nodal line.

26. A blade as claimed in claim 22 further comprising:

a nodal line associated with the second torsion mode of the blade, the nodal line passing chordally across the cooling air supply channel, and an uneven number of the pins above and below the nodal line and the pins being unevenly radially spaced above and below the nodal line.

27. A blade as claimed in claim 26 wherein there are a total of 9 of the pins of which 4 of the pins are above and 5 of the pins are below the nodal line.

* * * * *